US007475774B2

(12) United States Patent
Clarkson

(10) Patent No.: US 7,475,774 B2
(45) Date of Patent: Jan. 13, 2009

(54) DISPENSING CLOSURE

(76) Inventor: Aron Joseph Clarkson, P.O. Box 539, South Melbourne, Victoria (AU) 3205

( * ) Notice: Subject to any disclaimer, the term of this patent is extended or adjusted under 35 U.S.C. 154(b) by 345 days.

(21) Appl. No.: 10/570,599

(22) PCT Filed: Aug. 9, 2004

(86) PCT No.: PCT/AU2004/001064

§ 371 (c)(1),
(2), (4) Date: Mar. 6, 2006

(87) PCT Pub. No.: WO2005/023667

PCT Pub. Date: Mar. 17, 2005

(65) Prior Publication Data

US 2007/0023299 A1 Feb. 1, 2007

(30) Foreign Application Priority Data

Sep. 9, 2003 (AU) ..... 2003904913

(51) Int. Cl.
*B65D 25/08* (2006.01)

(52) U.S. Cl. ..... 206/222; 215/DIG. 8

(58) Field of Classification Search ..... 206/219, 206/222, 220; 215/257, DIG. 8
See application file for complete search history.

(56) References Cited

U.S. PATENT DOCUMENTS

| | | | | | |
|---|---|---|---|---|---|
| 3,603,469 | A * | 9/1971 | Magni | 206/222 |
| 5,029,718 | A * | 7/1991 | Rizzardi | 215/254 |
| 5,038,951 | A * | 8/1991 | Rizzardi | 215/256 |
| 5,461,867 | A | 10/1995 | Scudder et al. | |
| 5,543,097 | A * | 8/1996 | Fang | 264/102 |
| 5,782,345 | A * | 7/1998 | Guasch et al. | 206/222 |
| 6,138,821 | A | 10/2000 | Hsu | |
| 6,148,996 | A * | 11/2000 | Morini | 206/222 |
| 7,325,676 | B2 * | 2/2008 | Galaz Rodriguez | 206/219 |
| 7,347,322 | B2 * | 3/2008 | Cho | 206/222 |
| 2002/0096440 | A1 * | 7/2002 | Kasuya | 206/222 |
| 2003/0132244 | A1 | 7/2003 | Birkmayer et al. | |
| 2005/0161348 | A1 * | 7/2005 | Morini | 206/219 |

FOREIGN PATENT DOCUMENTS

| | | | |
|---|---|---|---|
| EP | 1222122 | B1 | 6/2003 |
| FR | 2453793 | A1 | 11/1980 |
| FR | 256966 | A1 | 3/1986 |
| GB | 1479370 | A | 7/1977 |
| WO | WO-01/46035 | A1 | 6/2001 |
| WO | WO-2004/033336 | A1 | 4/2004 |

* cited by examiner

*Primary Examiner*—Jacob K Ackun, Jr.

(57) ABSTRACT

A dispensing closure (15) for a container (20), such as a beverage container, is provided so as to selectively dispense a product (30) carried by the closure (15) into the container (20). The container has a neck portion with which the closure is engaged to close or seal the container (20). The closure (15) has a body (21) having an outer wall portion (22) to engage an outer surface of the container neck to releasably secure the closure to the container. The closure (15) is provided with a compartment (16) to contain the product (30) to be dispensed. The compartment (16) is formed by a cylindrical side wall (17), a top wall (18) and a frangible bottom wall (19). A cutting blade (31) is moveable relative to the side wall (17) and the bottom wall (19) to break open the frangible bottom wall (19) to selectively dispense the contents (30) into the container (20). The closure (15) has means restricting inadvertent relative movement of the cutting blade (31).

26 Claims, 15 Drawing Sheets

FIG 1,
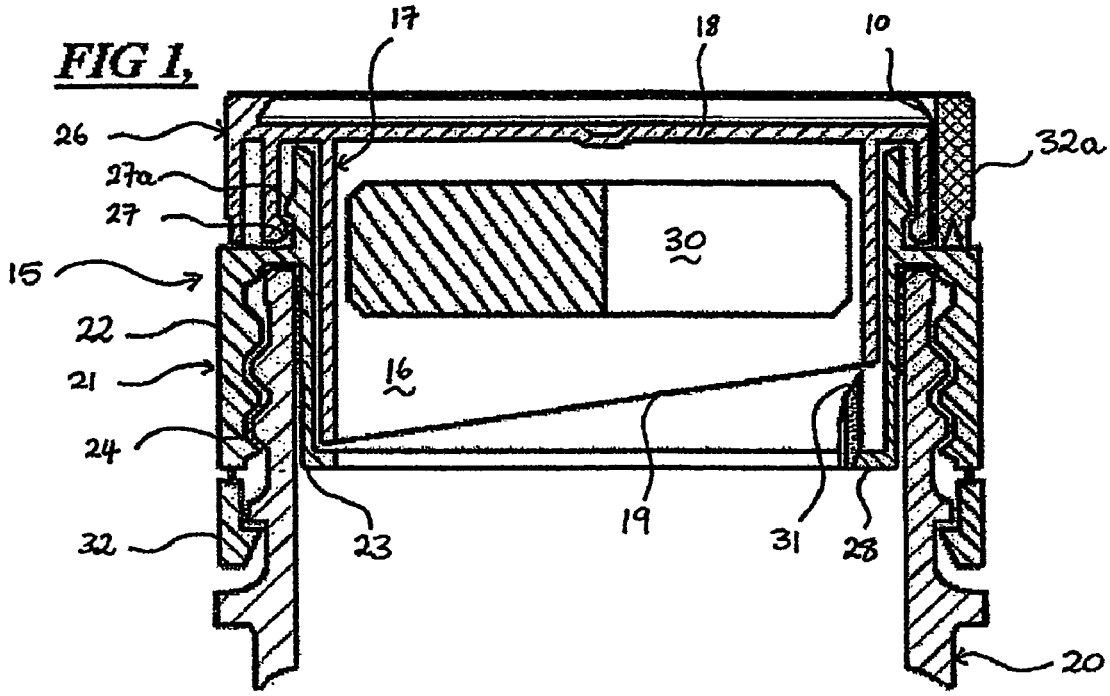
FIG 2,
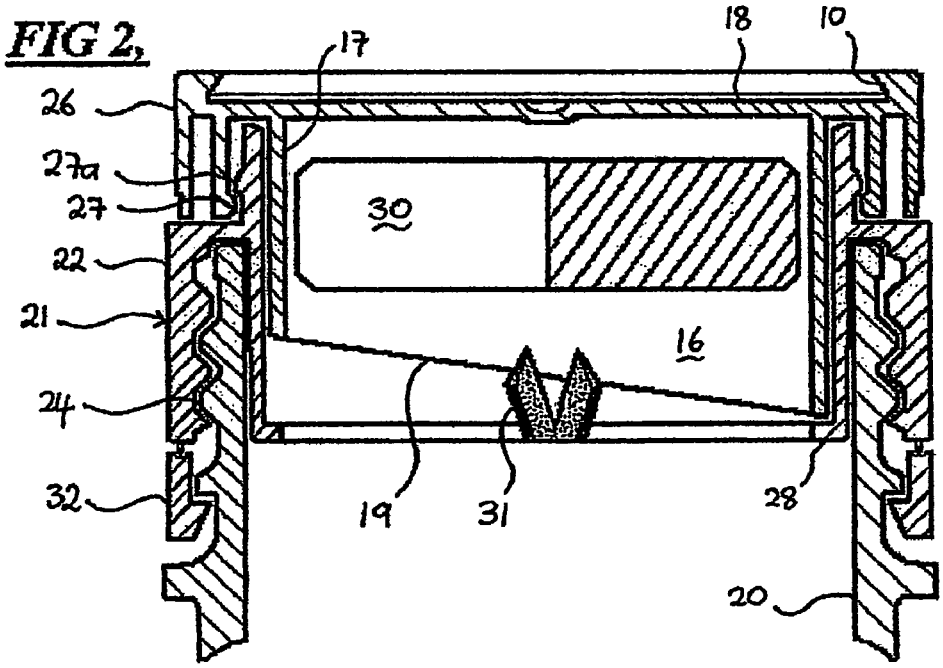

FIG 3,
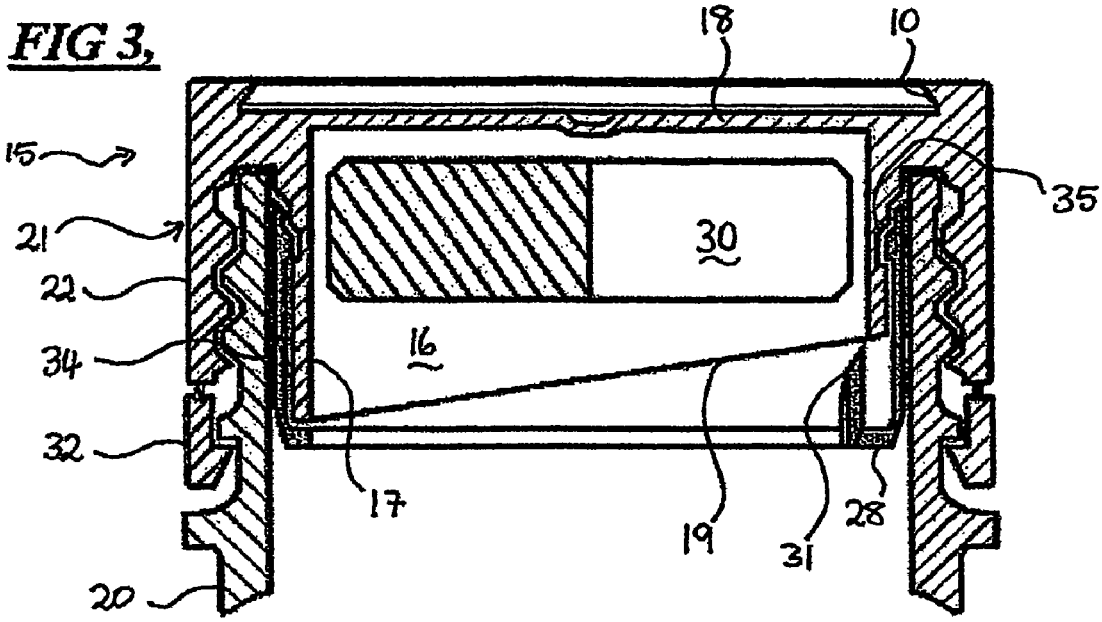
FIG 4,
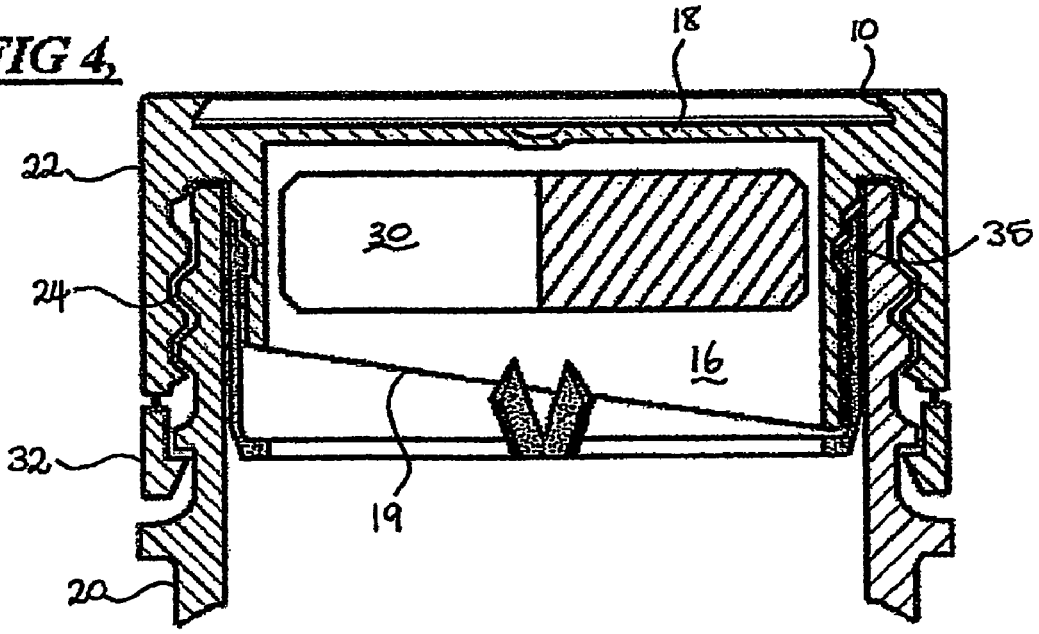

FIG 5,
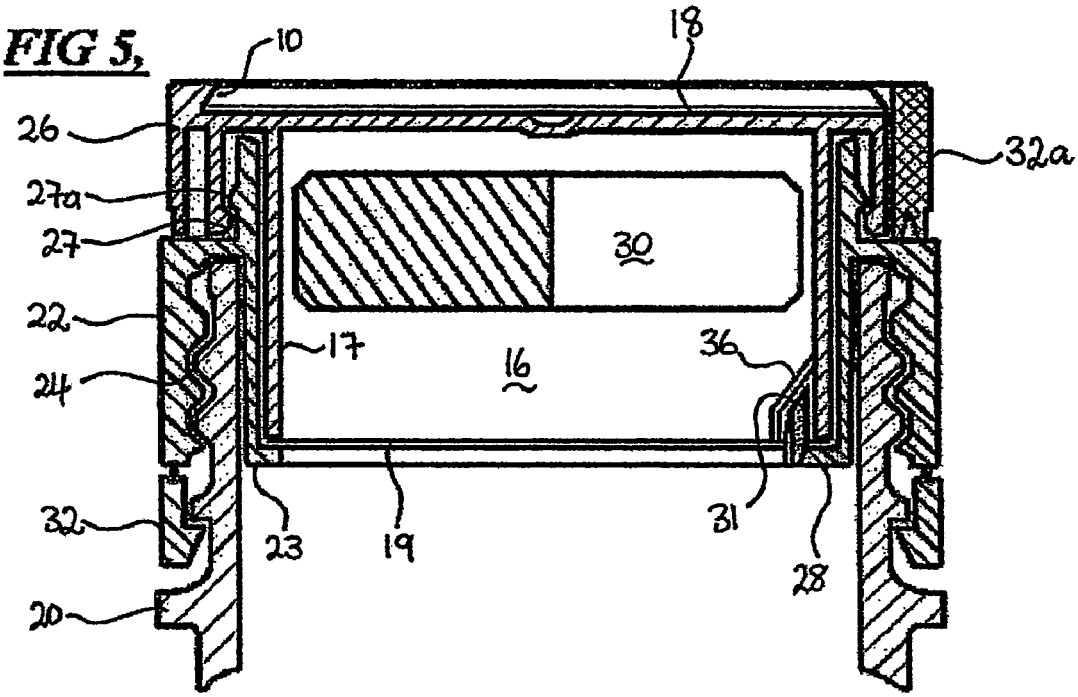
FIG 6,
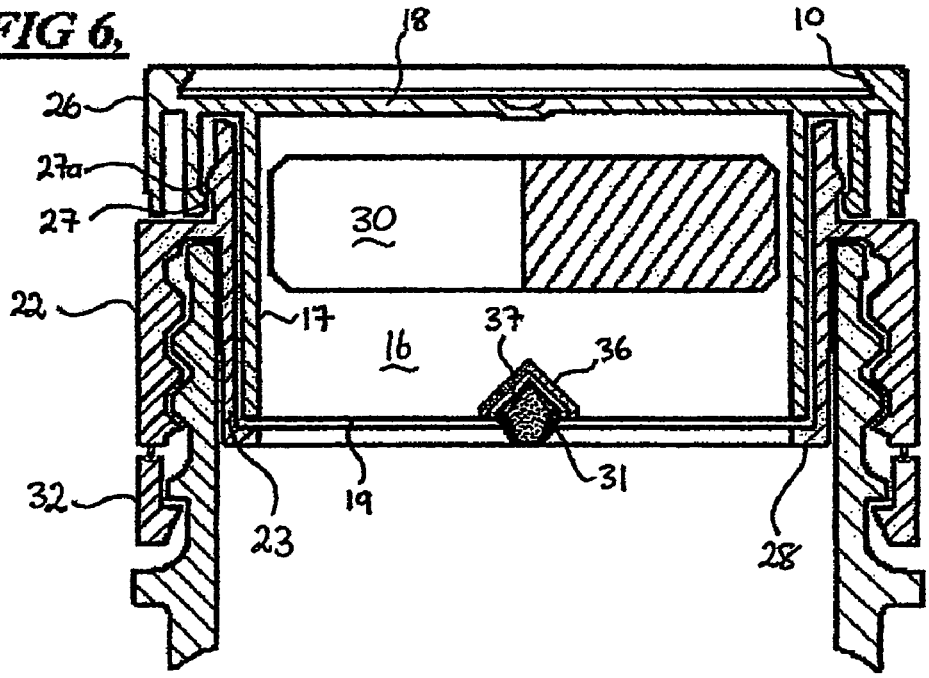

FIG 7,
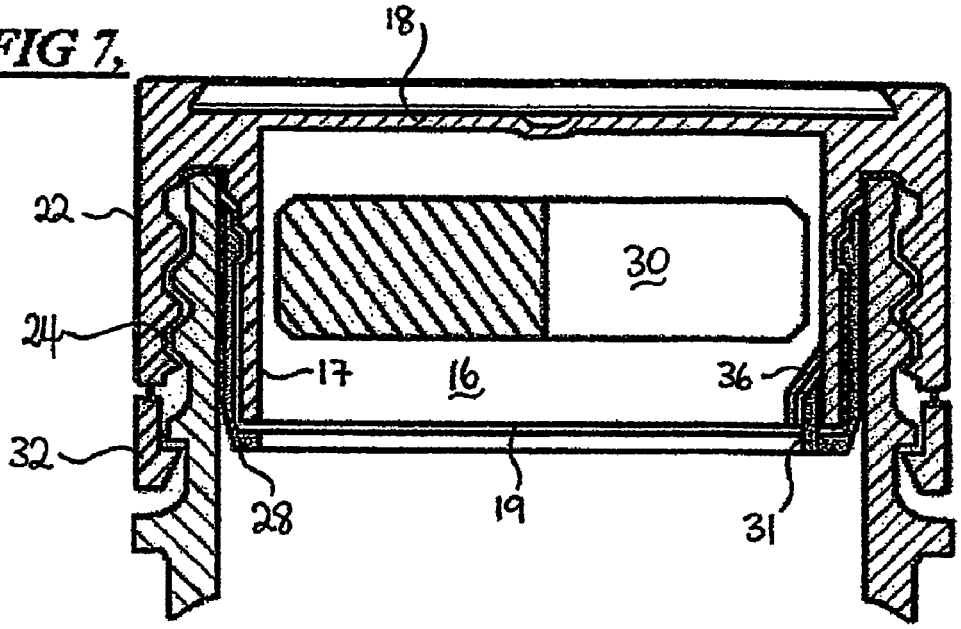
FIG 8,
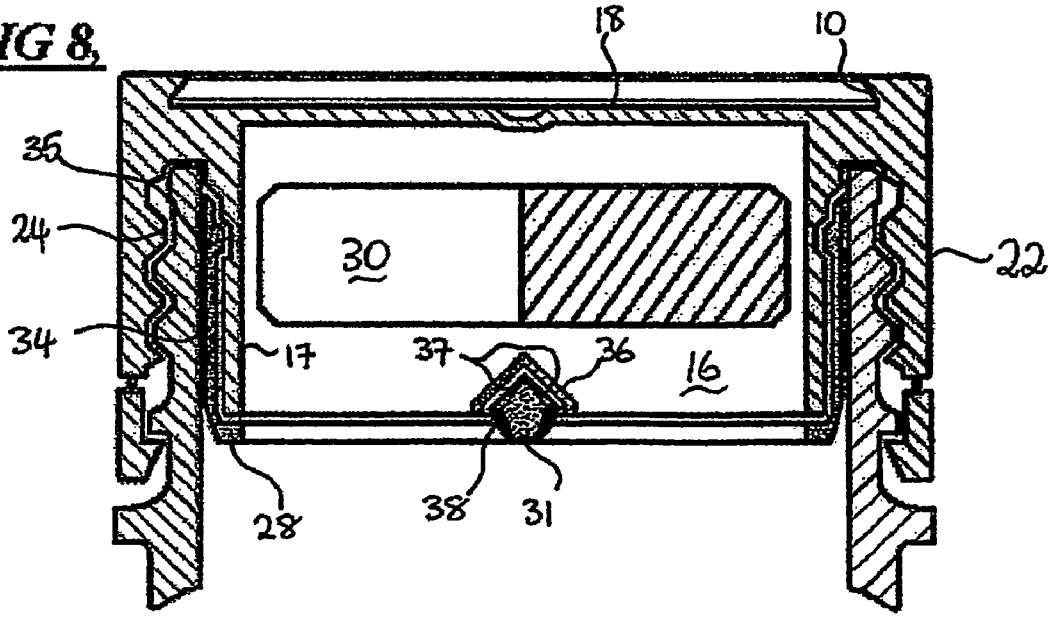

FIG 9,
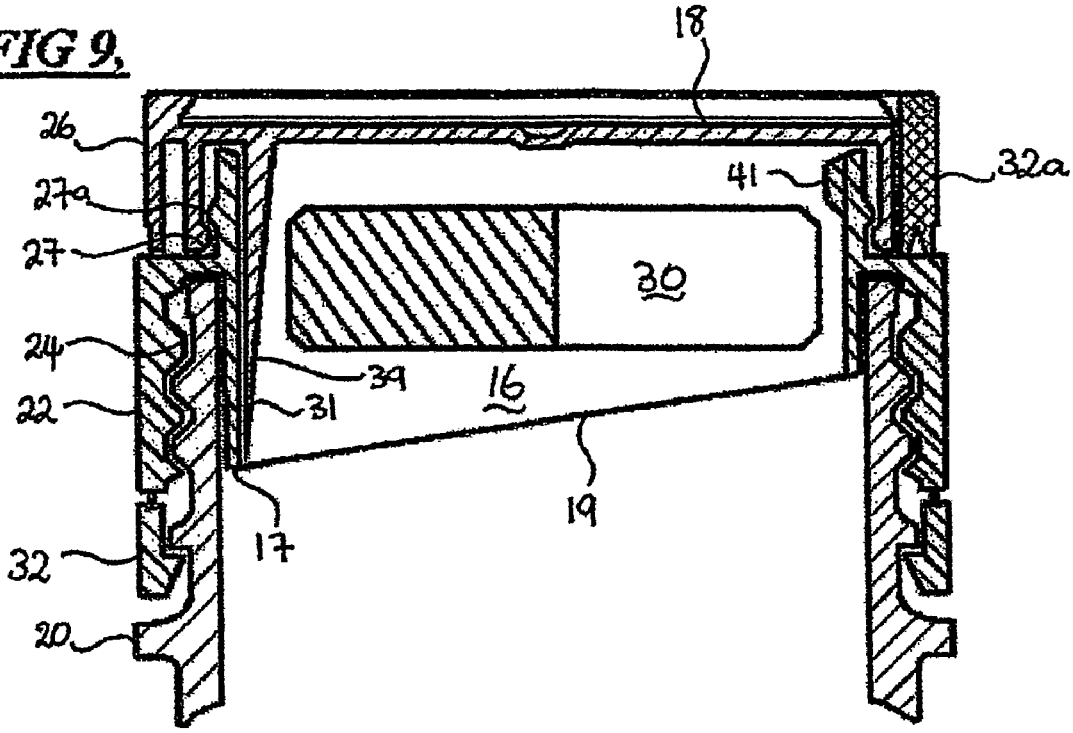
FIG 10,
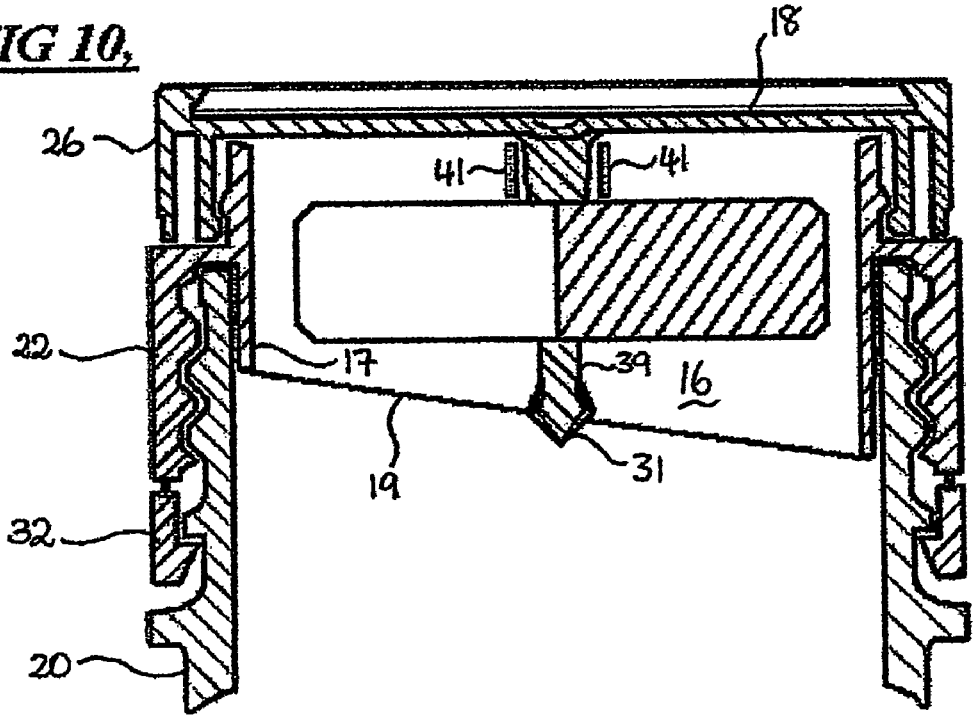

FIG 11,
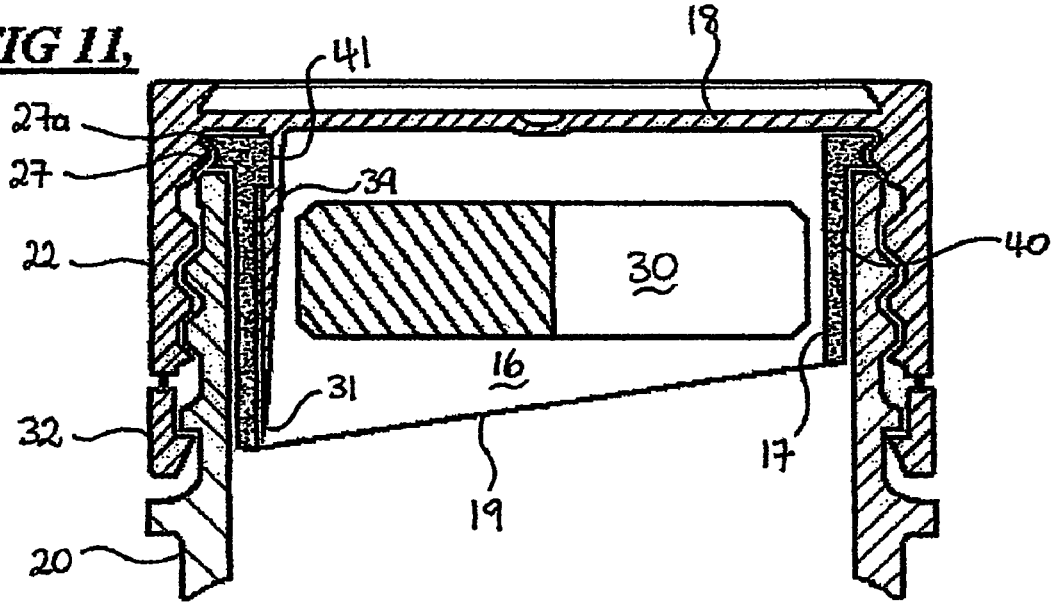
FIG 12,
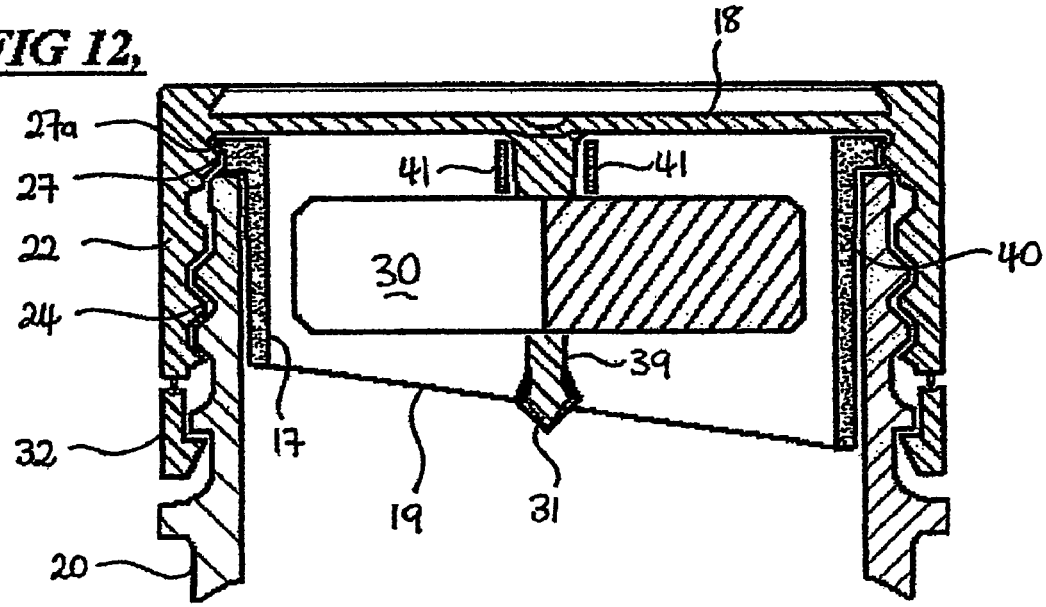

FIG 16,
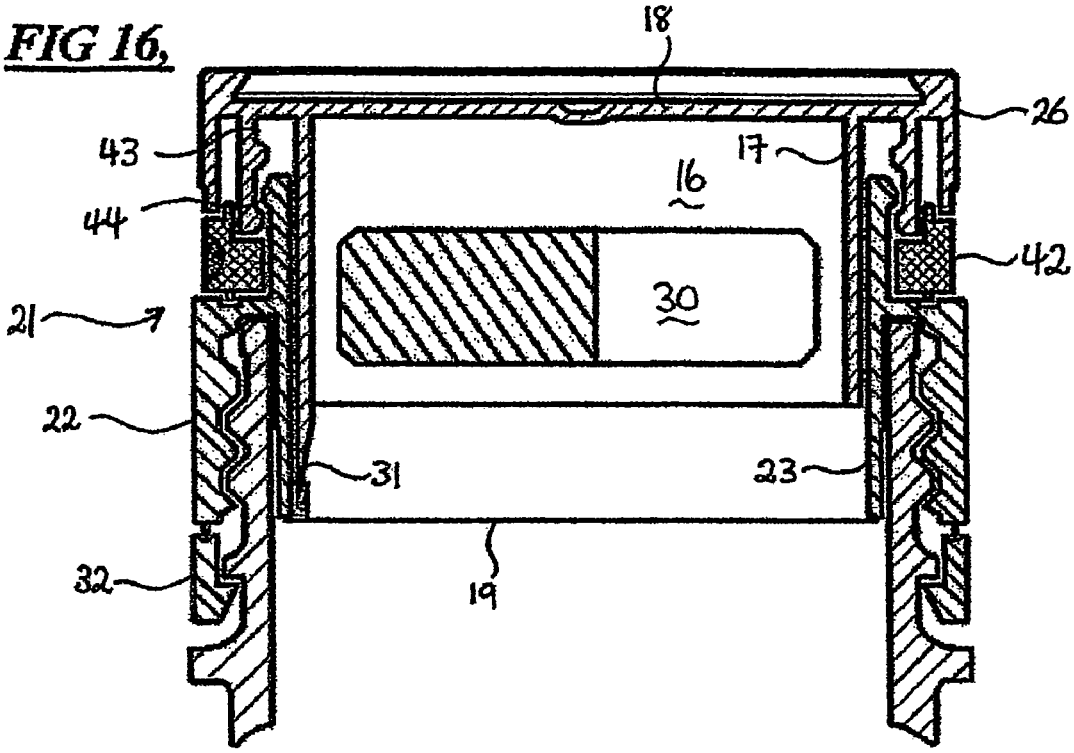
FIG 17,
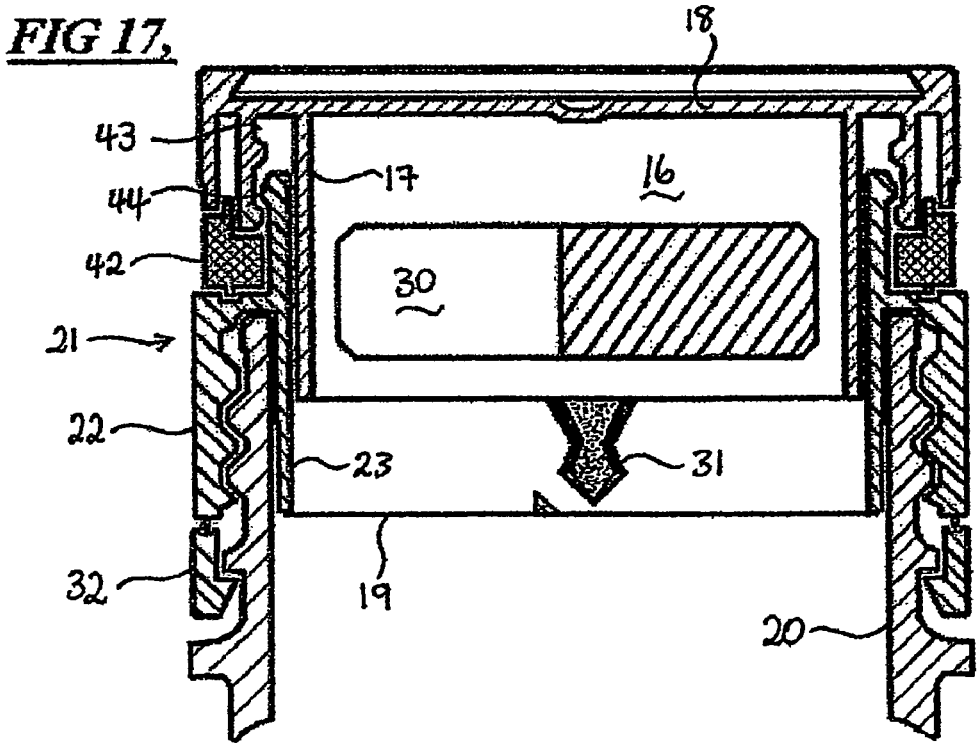

FIG 18,
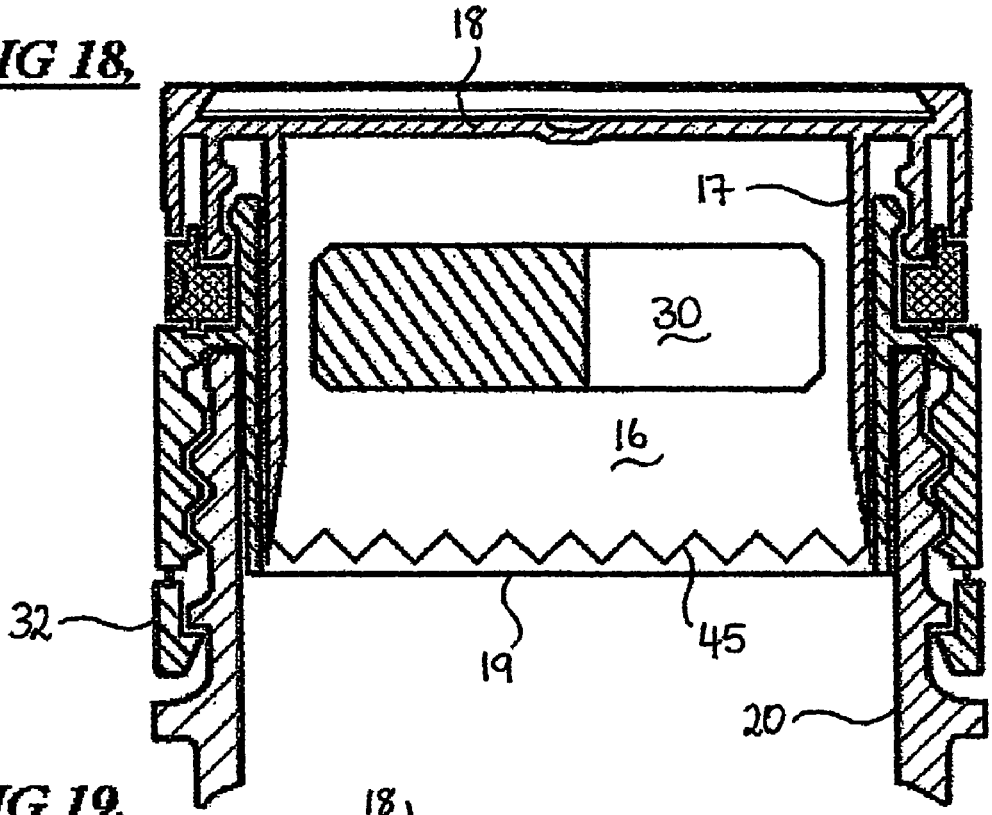
FIG 19,
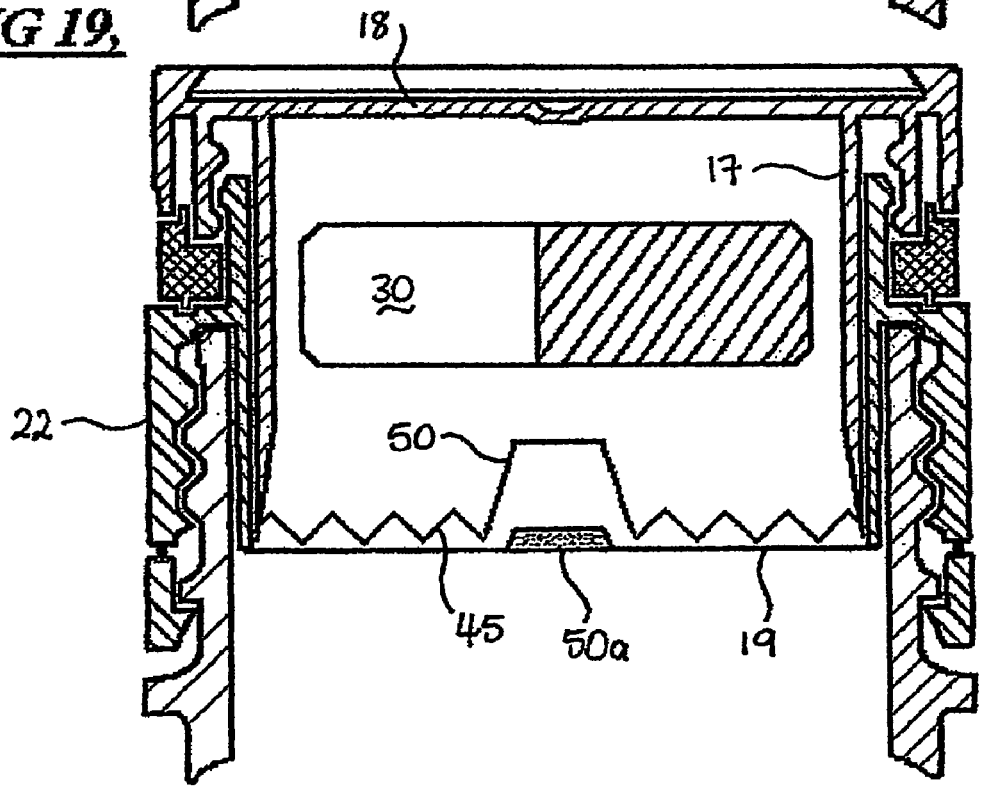

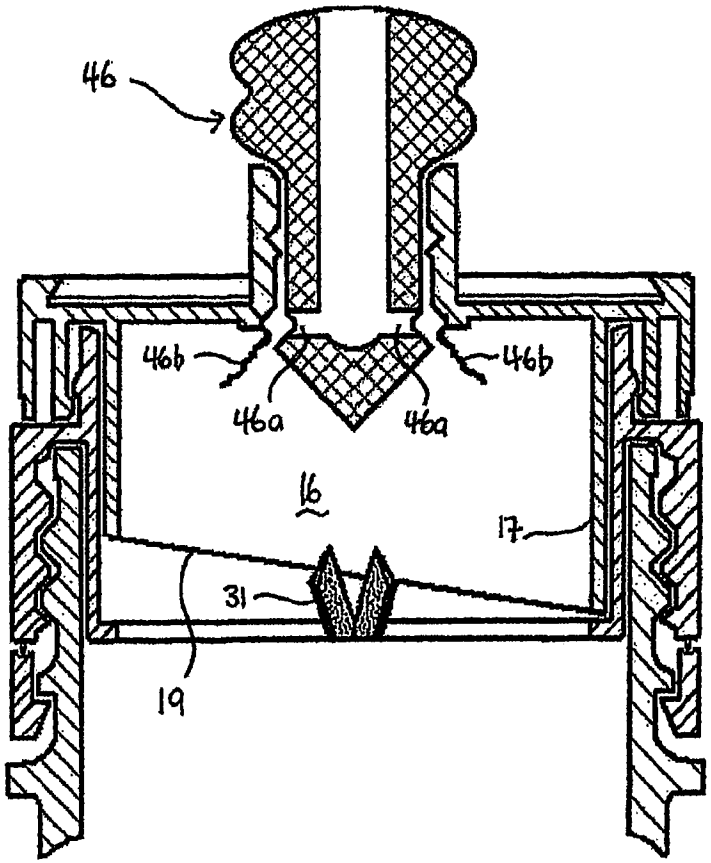
FIG 21,
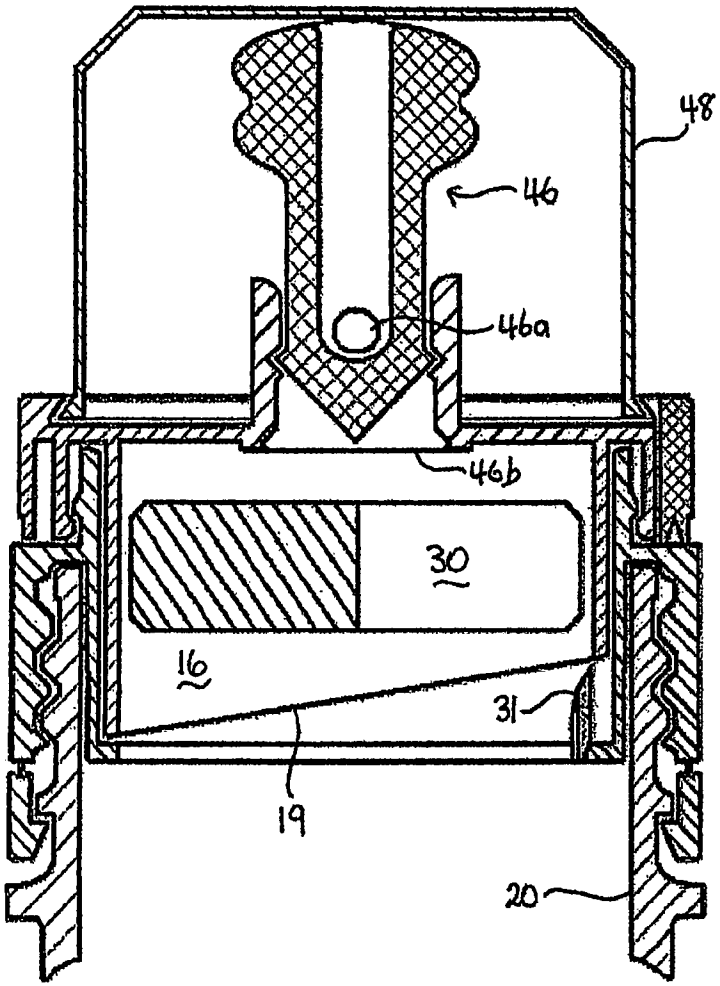
FIG 20,

FIG 22,
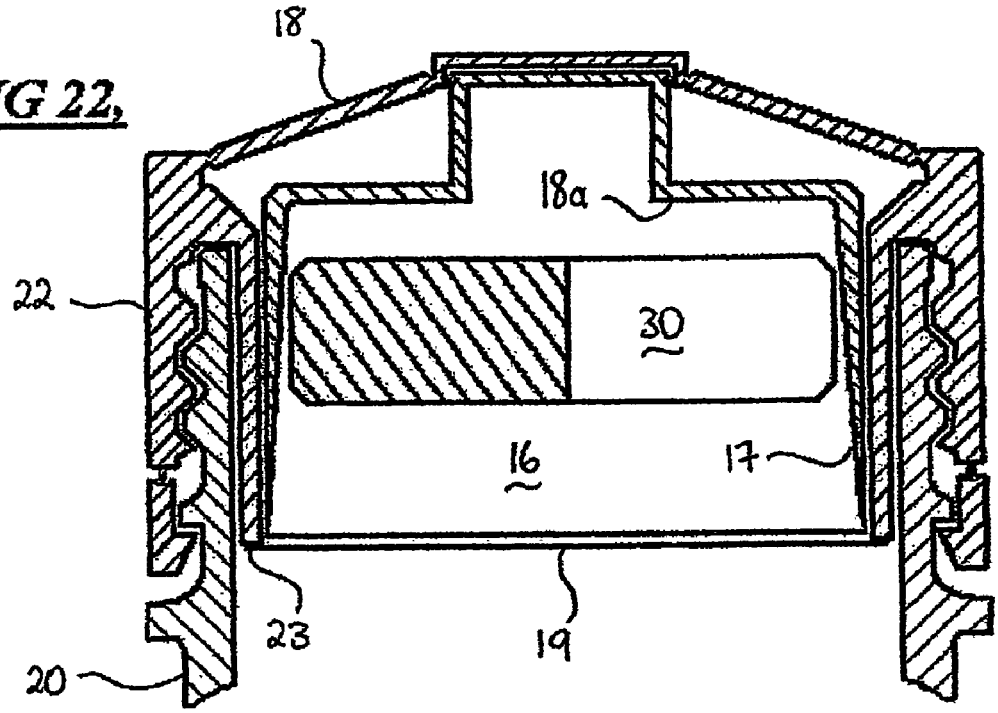
FIG 23,
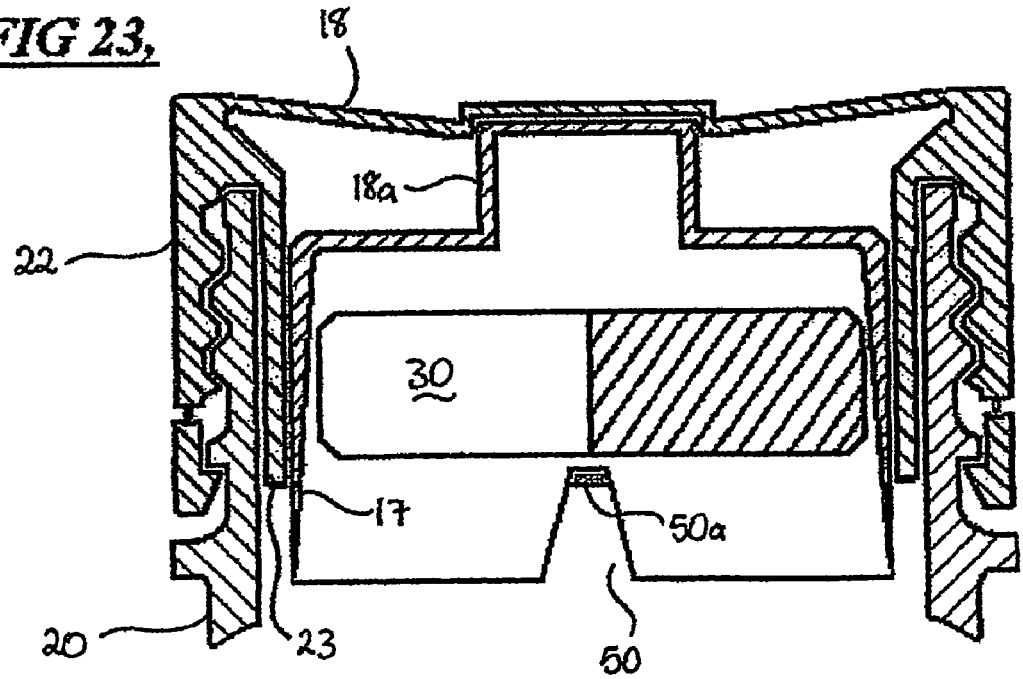

FIG 26,
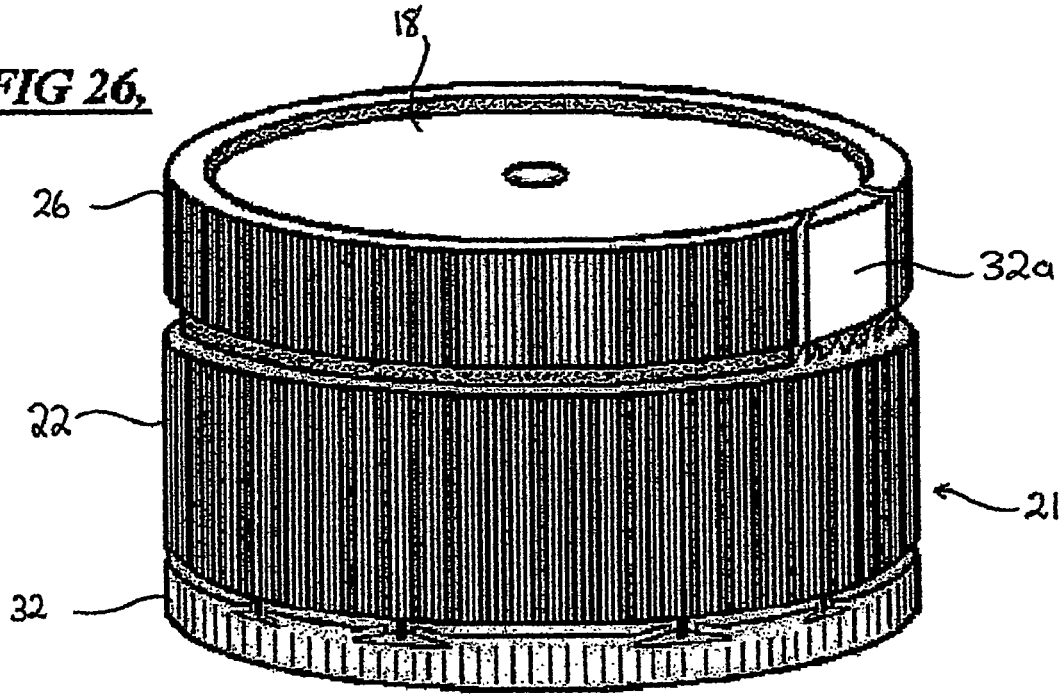
FIG 27,
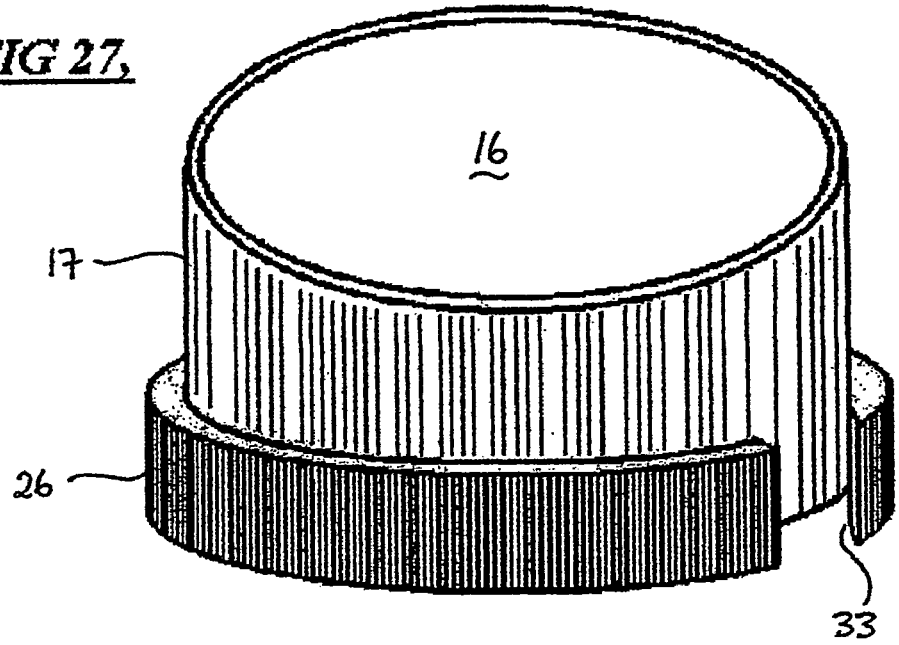

FIG 28,
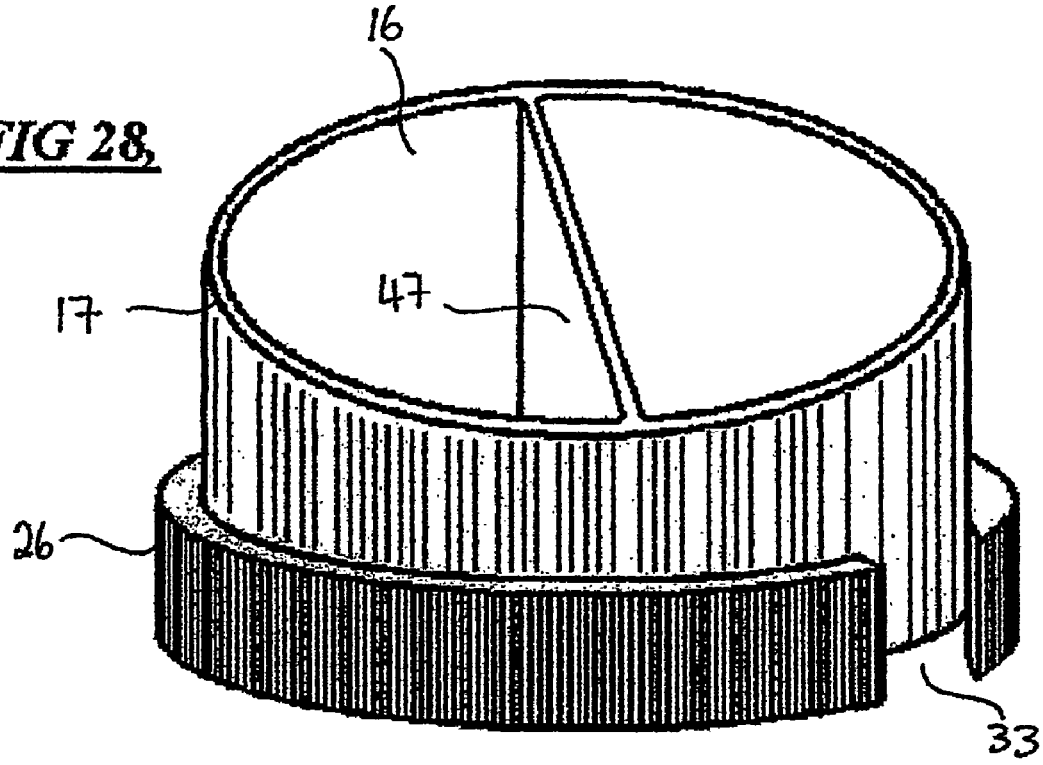
FIG 29,
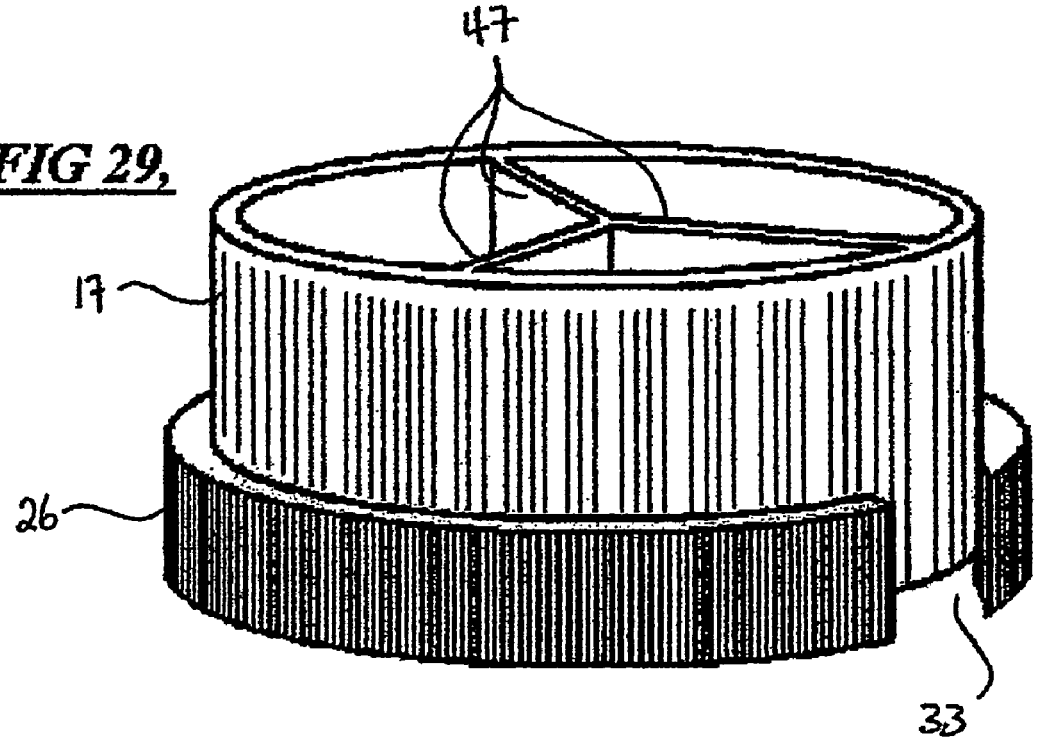

FIG 30,
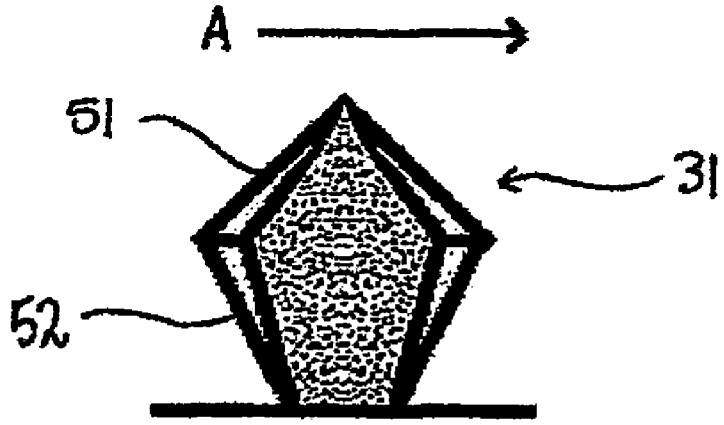
FIG 31,
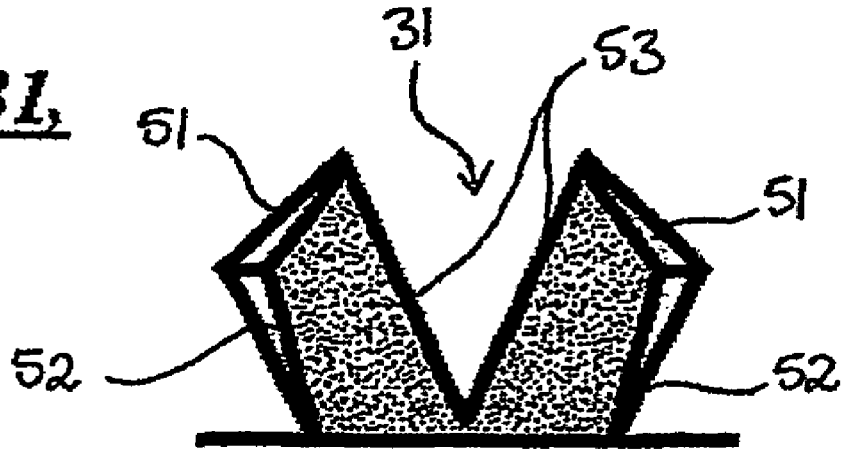

DISPENSING CLOSURE

CROSS-REFERENCE TO RELATED APPLICATIONS

This application is an U.S. national phase application under 35 U.S.C. §371 based upon co-pending International Application No. PCT/AU2004/001064 filed on Aug. 9, 2004. Additionally, this U.S. national phase application claims the benefit of priority of co-pending International Application No. PCT/AU2004/001064 filed on Aug. 9, 2004 and Australia Application No. 2003904913 filed on Sep. 9, 2003. The entire disclosures of the prior applications are incorporated herein by reference. The international application was published on Mar. 17, 2005 under Publication No. WO 2005/023667.

FIELD OF THE INVENTION

This invention relates to a dispensing closure for containers and relates particularly to a dispensing closure which is adapted to engage a container and facilitate dispensing of a material, such as a liquid, solid, powder or granular material, into the container.

BACKGROUND OF THE INVENTION

The invention will be described with particular reference to a cap for a liquid container, such as a beverage container. However, it will be appreciated that the principals of the invention can be applied to containers and closures of many different types to enable two or more materials to be kept separated up to the moment of use, and to then dispense, discharge or mix at least one of the materials into another. Thus, the invention is applicable to, for example, dispensing pharmaceuticals in liquid, powder, tablet or granule form into an appropriate medium for ingestion of the pharmaceutical; dispensing colour pigments, in liquid or powder form or in capsules, into base paint carriers; mixing cosmetic colouring material into a carrier; mixing chemicals, including catalysts and hardeners, and particularly those that may be toxic or dangerous to touch, into an active ingredient; discharging food flavouring, colouring, sweeteners or other food product into an appropriate beverage medium or the like. The invention is therefore useful for combining materials of many types where it is necessary or desirable to selectively dispense or mix one material or substance into another.

DISCUSSION OF PRIOR ART

A number of proposals have previously been made for containers to be constructed in a way that two products are maintained separated until the moment of use at which time one product is admixed with the other in the container. Containers of this type have been proposed with closures which are used to effect the product separation and facilitate the introduction of one product into the other. However, the containers and closures previously proposed are relatively complicated. For example, in one proposal, a closure is formed of three parts, a first part including a compartment to hold one product, the compartment being adapted to engage in the neck of a container, a second part which moves relative to the first part and has a means for opening a bottom wall of the compartment to release the first product into the container, and a sealing cap which engages over the compartment and second part to seal the closure on the container.

Such a structure is relatively complicated and expensive to manufacture, requires the assembly of three separate parts as well as introduction of a product into the compartment during assembly, and necessarily involves a number of separate actions in order to release the product in the compartment into the container.

In another proposal as outlined in Patent GB2012714, a container is disclosed having an inner wall which divides the container into two compartments. An upper compartment contains a piercing device that is moveable by pressure applied to a top wall to cause a tip of the piercing device to pierce a hole in the dividing wall. However, this structure requires a moveable top wall and is, therefore, susceptible to accidental actuation.

It is therefore desirable to provide an improved dispensing closure for containers which obviates at least some of the disadvantages of previously proposed dispensing closures.

It is also desirable to provide a dispensing closure for containers whereby a material or substance in liquid, powder, solid, granular or other form is able to be quickly and easily dispensed into the product in the container on which the closure is attached.

It is also desirable to provide a dispensing closure for containers which is relatively easy to produce, assemble and use.

It is also desirable to provide a dispensing closure for a variety of container types, including beverage containers, paint containers, cosmetic containers and others.

It is also desirable to provide a dispensing closure which may be adapted for a variety of different products to be dispensed into the container on which the closure is mounted.

SUMMARY OF THE INVENTION

According to one aspect of the invention there is provided a dispensing closure to dispense at least one product into a container, the closure including a container closure body adapted to sealingly engage with a neck of the container, the body having securing means to secure the closure to the container neck, a compartment to contain the at least one product to be dispensed, the compartment being adapted to fit within the container neck and being defined by a side wall, a top wall and a frangible bottom wall, and cutting means moveable relative to the side wall and the bottom wall to break open the frangible bottom wall of the compartment to selectively dispense contents of the compartment into the container.

In one form of the invention, the closure body includes an outer, cylindrical wall and a coaxial inner wall. The outer wall is provided with internal threads adapted to threadingly engage the threaded neck of a container to which the closure is to be fitted. The inner wall engages within the container neck, and the compartment fits within the inner wall. The upper end of the compartment is formed with a radially outwardly extending flange having reversely formed shoulders to engage corresponding shoulders on the closure body. In this way, the two parts of the closure are able to be snap-fitted together so that the compartment is able to rotate about its axis relative to the body. In this embodiment, the inner wall of the body carries a cutting knife edge which is inwardly and upwardly turned towards the frangible bottom wall of the compartment. The bottom wall of the compartment extends at an angle to a plane perpendicular to the axis such that, in first assembled position, the bottom wall does not contact the knife. On relative rotation of the compartment, however, the frangible bottom wall is brought into contact with the knife which cuts and breaks the wall from the compartment permitting contents thereof to be dispensed into the container to which the closure is fitted.

In another embodiment of the invention, the compartment and closure body are integral and are engaged with a cylindrical band which fits over the wall of the compartment. The band carries the cutting knife which operates in the manner described above.

Preferably, the container closure body includes, on the lower end of the outer wall, a tamper proof evidence release band to provide any indication of tampering with the closure prior to its use.

According to another aspect of the invention there is provided a dispensing device for dispensing product into a container, the device having a sealed compartment containing the product, the compartment having a substantially cylindrical side wall, a frangible bottom wall and a top wall, the compartment being adapted to fit within a neck of the container, the device further having an outer wall to engage an outer surface of the container neck and including securing means to secure the device to the container, and cutting means adapted to be rotated relative to the frangible bottom wall, the cutting means and/or the frangible bottom wall being arranged such that the relative movement causes the cutting means to break open the frangible bottom wall of the compartment to selectively dispense contents of the compartment into the container.

The cutting means may extend from a separate cylindrical band coaxial with the side wall of the compartment but rotatable relative thereto. Alternatively, the compartment and outer wall may be separate integers with the cutting means extending from an intermediate wall located between the compartment and the inner surface of the neck of the container.

According to a further aspect of the invention there is provided a method of dispensing at least one product into a container, the method including the steps of assembling a compartment containing a product to be dispensed with a closure body, engaging the assembled closure with a neck portion of a container into which the contents are to be dispensed, providing a cutting knife adjacent to a bottom wall of the assembled closure, and rotating the knife relative to the bottom wall to cause the knife to cut into the bottom wall to thereby release the contents of the compartment into the container.

According to a further aspect of the present invention there is provided a cutting knife for use with a dispensing closure, the knife being integrally moulded with a wall of the closure, the knife having at least two cutting edges extending at an acute angle to each other.

In order that the invention is more readily understood, embodiments thereof will now be described with reference to the accompanying drawings wherein:

FIG. 1 is a cross sectional, elevational view of a first embodiment of the invention;

FIG. 2 is a cross sectional, elevational view of the first embodiment of the invention taken at 900 to that of FIG. 1;

FIG. 3 is a cross sectional, elevational view of a second embodiment of the invention;

FIG. 4 is a cross sectional, elevational view of the second embodiment of the invention taken at 900 to that of FIG. 3;

FIG. 5 is a cross sectional, elevational view of a third embodiment of the invention;

FIG. 6 is a cross sectional, elevational view of the third embodiment of the invention taken at 900 to that of FIG. 5;

FIG. 7 is a cross sectional, elevational view of a fourth embodiment of the invention;

FIG. 8 is a cross sectional, elevational view of the fourth embodiment of the invention taken at 900 to that of FIG. 7;

FIG. 9 is a cross sectional, elevational view of a fifth embodiment of the invention;

FIG. 10 is a cross sectional, elevational view of the fifth embodiment of the invention taken at 900 to that of FIG. 9;

FIG. 11 is a cross sectional, elevational view of a sixth embodiment of the invention;

FIG. 12 is a cross sectional, elevational view of the sixth embodiment of the invention taken at 900 to that of FIG. 11;

FIG. 16 is a cross sectional, elevational view of an eighth embodiment of the invention;

FIG. 17 is a cross sectional, elevational view of the eighth embodiment of the invention taken at 900 to that of FIG. 16;

FIG. 18 is a cross sectional elevational view of a ninth embodiment of the invention;

FIG. 19 is a cross sectional, elevational view of the ninth embodiment of the invention taken at 900 to that of FIG. 18;

FIG. 20 is a cross sectional, elevational view of a tenth embodiment of the invention;

FIG. 21 is a cross sectional elevational view of the tenth embodiment of the invention taken at 900 to that of FIG., and showing an initial actuation of the closure;

FIG. 22 is a cross sectional, elevational view of an eleventh embodiment of the invention;

FIG. 23 is a cross sectional, elevational view of the eleventh embodiment of the invention taken at 900 to that of FIG. 1, and showing an initial actuation of the closure;

FIG. 26 is a perspective view of a form of closure in accordance with embodiments of the invention;

FIG. 27 is a perspective view of a compartment for a closure, shown upside down, in accordance with embodiments of the invention;

FIG. 28 is a perspective view of another compartment for a closure, shown upside down, in accordance with embodiments of the invention;

FIG. 29 is a perspective view of a further form of compartment for a closure, shown upside down, in accordance with other embodiments of the invention;

FIG. 30 is an enlarged elevational view of one embodiment of cutting knife in accordance with the invention; and FIG. 31 is a perspective view of a further form of cutting knife in accordance with some embodiments of the present invention.

Figure 14:
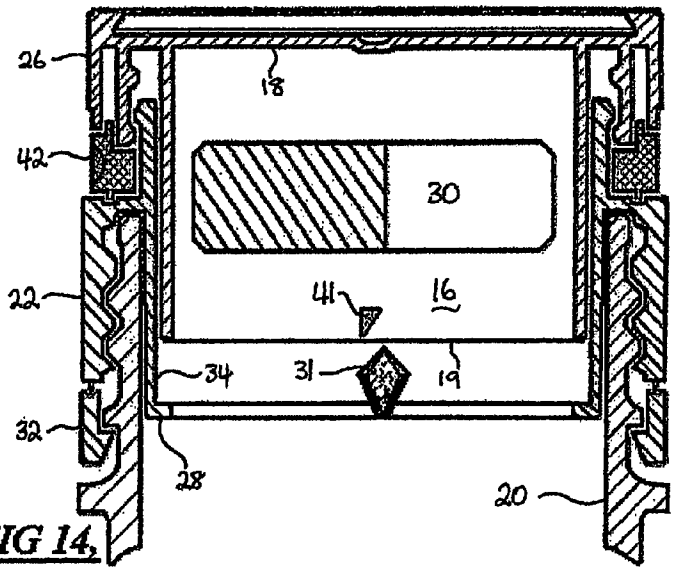
FIG. 14 is a cross sectional, elevational view of the seventh embodiment of the invention taken at 900 to that of FIG. 13.

Referring to the drawings, FIGS. 1 and 2 illustrates a first embodiment of the invention in which a dispensing closure 15 has a compartment 16 defined by a cylindrical side wall 17, a top wall 18 and a frangible bottom wall 19.

The height of the side wall 17 varies around the perimeter of the compartment 16 so that the bottom wall 19 extends at an angle to a plane perpendicular to the axis of the cylindrical side wall 17.

The closure of this embodiment includes a closure body 21 which comprises an outer side wall 22 and an intermediate wall 23. The outer side wall 22 is provided with internal threads 24 that engage with corresponding threads on the neck of a container 20 to which the closure is fitted. When fitted to the neck of a container 20 as shown, the intermediate wall 23 closely engages the internal surface of the container 20 neck.

The top wall 18 of the compartment 16 has an outwardly and downwardly extending rim 26 with an inwardly directed shoulder 27 to engage a corresponding shoulder 27*a* on an upper extension of the intermediate wall 23. Thus, the compartment 16 and closure body 21 are snapped into engagement by the inter-engagement of the respective shoulders 27 and 27*a*. The engagement, however, is sufficiently free that the compartment 16 is able to rotate relative to the closure body 21 about the axis of the closure 15.

A lower edge of the intermediate wall 23 carries an inwardly extending flange 28. At one point around the flange 28, a cutting blade 31 extends upwardly from the inner edge of the flange 28 towards the top wall 18 of the compartment 16. The blade 31 is spaced from the intermediate wall 23 by a distance that is slightly greater than the thickness of the side wall 17.

When the compartment 16 is assembled with the closure body 21, the blade 31 is located at that portion of the side wall 17 having the least extent so that the blade 31 does not penetrate the frangible bottom wall 19.

When the closure 15 is engaged with the neck of a container 20, the compartment 16 is located width the container 20 neck. A tamper-proof evident release band 32 extends from the lower edge of the outer side wall 22 to provide evidence of tampering with the closure 15 after engagement with a container 20. A further tamper evident tab 32*a* is formed integral with the upper edge of the outer side wall 22, the tab 32*a* being adapted to engage within a cooperating gap in the rim 26, as described and shown with reference to FIGS. 26 and 27.

In use of the closure 15, when it is desired to dispense a product sealed within the compartment 16, after removal of the tab 32*a*, the rim 26, which is preferably provided with a knurl ribs or the like, is rotated relative to the closure body 21 thereby causing the angled bottom wall 19 to engage with the upper edge of the blade 31. The blade 31 cuts into the bottom wall 19 with continued rotation thereof thereby releasing the bottom wall 19 to enable contents 30 of the compartment 16 to fill into the container 20. Shoulders or the like may be provided to prevent relative rotation to less than 3600 so that the bottom wall remains connected by a small portion to the side wall 17.

The contents 30 of the compartment 16 may be any of those referred to above or any product that is to be mixed with another within the container 20.

The frangible bottom wall 19 may be formed of an aluminium foil which is adhered to the lower edges of the side wall 17. Alternatively, the frangible bottom wall 19 may be formed of the same material as the side wall 17, or it may be of any other suitable material for sealing contents 30 within the compartment 16, such as a synthetic plastics material adhered or welded to the lower edge of the side wall 17.

The top wall 18 is formed with an undercut lip 10 for receipt and retention of a label, marker, price disk or other material.

Referring to FIGS. 3 and 4, this embodiment is similar to that shown in FIGS. 1 and 2 except that the compartment 16 is formed integral with the outer side wall 22. In this embodiment, a cylindrical band 34 is a snap-fit over the outer surface of the compartment side wall 17, which is formed with an appropriate groove 35. The cylindrical band 34 carries the inwardly extending flange 28 and the cutting blade 31.

In use of the closure of this embodiment, the cylindrical band frictionally engages the inner surface of the container 20 neck thereby holding the band against rotation during rotational movement of the compartment 16. The outer side wall 22 may be formed with threads, as described previously, or is provided with ribs, ridges or the like which enable the closure to be snap-fitted to the neck of a container 20.

In the event that threads are used, an internal groove and stop shoulder may be used so that the compartment 16 is able to be rotated relative to the cylindrical band 34 in one direction only, the shoulder preventing rotation in the opposite direction. This, then, enables the cap to be screwed onto a container 20 neck without relative rotation occurring, but reverse relative rotation will cause the compartment 16 to rotate relative to the blade 31 thereby causing the blade to cut into the frangible bottom wall 19 to release the contents 30 of the compartment which pass into the container 20.

Referring to FIGS. 5 and 6, this embodiment is similar to that of FIGS. 1 and 2 in which a separate compartment 16 and separate closure body 21 are utilised, the parts being fitted together through inter-engaging shoulders 27.

In this embodiment, the bottom wall 19 extends in a plane perpendicular to the axis of the closure 15. The cutting blade 31 is contained in a protective pocket 36 formed at one side of the side wall 17. Relative rotation between the compartment 16 and the closure body 21 causes the cutting blade 31 to jump out of the protective pocket 36 thereby causing the blade to pierce and cut through the frangible bottom wall 19 releasing the contents 30 of the compartment 16 into the container 20.

The cutting knife 31, which is shown in both side and front views in FIGS. 5 and 6 has two cutting edges 37 angled away from each other which ensures that the knife is able to cut irrespective of the direction of relative rotation of the compartment 16 and the closure body 21. Referring to FIGS. 7 and 8, this embodiment is similar to that of FIGS. 3 and 4 but incorporating the bottom wall and knife construction of FIGS. 5 and 6.

The cutting blade 31 of this and the previous embodiment has a third cutting edge 38 which is substantially parallel to the first cutting edge. It has been found, in use, that when the compartment 16 is rotated relative to the cylindrical band 34 in a direction that moves the cutting blade 31 as illustrated in FIG. 8 towards the right, the action of cutting also causes the cut bottom wall 19 to peel downwardly thereby facilitating release of contents 30 of the compartment 16 into the container 20 to which the closure 15 is fitted.

Referring to FIGS. 9 and 10, a modified construction of closure is illustrated in which the compartment 16 is defined by the side walls 17, which fit closely within the container 20 neck, and a separate top wall 18 that is attached to the side wall 17 by the inter-engaging shoulders 27. In this embodiment, the cutting blade 31 is disposed on the end of a downwardly extending carrier 39. The compartment 16 is thus formed of separate parts snap-fitted together, and is particularly suitable for a product which is unaffected by the atmosphere.

A shoulder 41 is provided at the upper edge of the side wall 17 at that part of the side wall of least extent to restrict relative rotation of the blade carrier 39 so that the bottom wall 19 is not completely severed from its engagement with the side wall 17.

As with all other embodiments, the outer side wall 22 may be provided with internal screw threads or snap-fitting ribs or ridges or the like for engagement with a correspondingly shaped neck of the container 20 to which the closure is to be fitted.

Referring to FIGS. 11 and 12, this embodiment is similar to that of FIGS. 9 and 10 except that the outer side wall 22 is formed integral with the top wall 18 and is snap-fitted to the side wall 17 of the compartment 16 using the inter-engaging shoulders 27.

The side wall 17 is formed with an annular enlargement 40 on its outer surface that tightly engages against the inside surface of the container 20 neck. The enlargement 40 holds the side wall 17, and the bottom wall 19, against rotation relative to the container 20 neck when the outer wall 22, and the integral blade carrier 39, is rotated thereby enabling the blade 31 to cut through the bottom wall 19.

Figure 13:
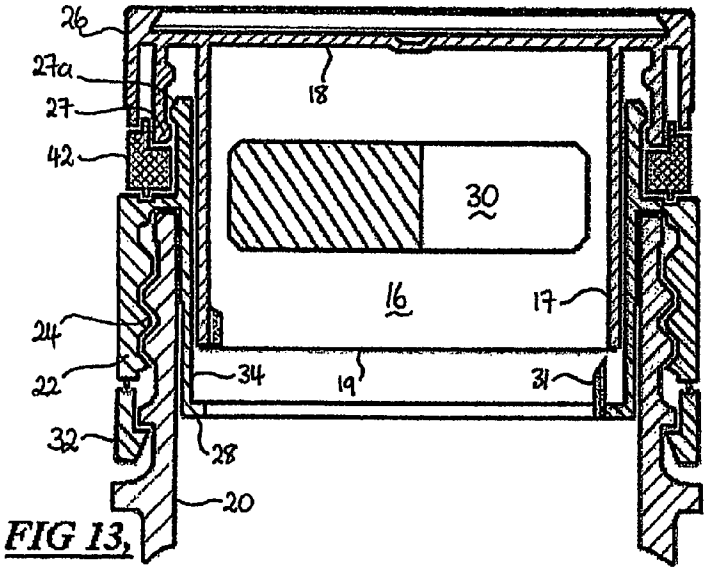
FIG. 13 is a cross sectional, elevational view of a seventh embodiment of the invention.
Figure 15:
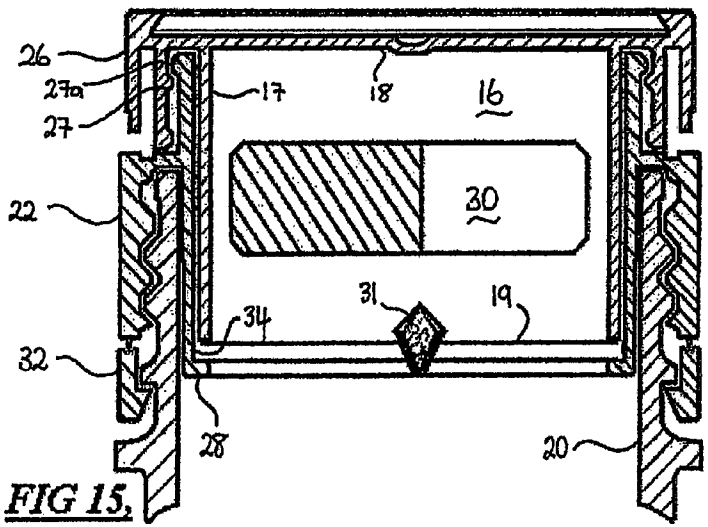
FIG. 15 is a cross sectional, elevational view of the seventh embodiment of the invention similar to FIG. 14 showing the closure after an initial actuation.

Referring to FIGS. 13 to 15, this embodiment is similar to that of FIGS. 5 and 6. However, in this embodiment, the rim 26 of the top wall 18 is provided with a tamper proof evident band 42 which extends from the outer edge of the top wall to engage with the upper edge of the outer side wall 22. The inter-engaging shoulders 27 and 27*a* are separated, and the cutting blade 31, carried by the flange 28, is spaced from the frangible bottom wall 19. In this embodiment, there is no protective pocket for the cutting blade 31.

The contents 30 of the compartment 16 are released, in this embodiment, by removal of the tamper proof evident band 42 thereby permitting the compartment 16 to be snap-engaged with the closure body 21 by a relative axial, downward movement of the compartment 16. Such movement causes the cutting blade 31 to cut into the frangible bottom wall 19 whereupon relative rotation of the respective compartment 16 and closure body 21 causes the cutting blade to cut around the edge of the bottom wall 19 and break open the bottom wall 19 to release the contents 30 of the compartment 16.

The shoulder 41 acts to stop the rotational movement of the cutting blade 31 cutting through a full 3600, thereby retaining a connection between the bottom wall 19 and side wall 17 which stops the severed bottom wall falling into the container 20.

Referring to FIGS. 16 and 17, the dispensing closure of this embodiment is designed particularly for use on containers having a threaded neck, such as a beverage bottle or the like. The closure comprises a compartment 16 engaged with a closure body 21. The compartment has a top wall 18 and a side wall 17 while the body has an outer wall 22, an intermediate wall 23 and a bottom wall 19 formed of a frangible membrane which extends from the lower edges of the intermediate wall 23. The peripheral edge of the top wall 18 is formed with a groove 43 to receive a rib 44 extending from the closure body 21 when the compartment 16 and body 21 are moved to a dispensing position. A cutting blade 31 extends downwardly from the side wall 17 so that, on relative axial downward and rotational movement of the compartment 16 and body 21, the cutting blade 31 pierces and cuts the membrane forming the bottom wall 19 thereby permitting contents 30 of the compartment to be dispensed into the container 20.

If desired, means for relatively rotating the compartment and the closure body, such as grooved outer surfaces, may be provided on periphery of the top wall 18 and on the outer side wall 22 to facilitate cutting and removal of the bottom wall or membrane 19.

Referring to FIGS. 18 and 19, this embodiment is similar to that of FIGS. 16 and 17 except that the side wall 17 is formed at its lower edge as a serrated cutter 45 that engages and cuts through the bottom wall or membrane 19 on relative axial movement in a downward motion between the compartment 16 and the closure body 21.

A portion 50 of the side wall 17 is relieved adjacent a hinge 50*a* whereby a section of the bottom wall 19 is not cut by the cutter 45 allowing the cut wall part to fold down about the hinge 50*a* to allow the contents 30 to fall into the container 20.

Referring to FIGS. 20 and 21, this embodiment is similar to that of FIGS. 1 and 2 except that the top wall is formed with a release valve 46 which allows contents of the container 20, when mixed with the contents 30 of the compartment 16, to be withdrawn from the container 20 through the valve 46.

The release valve 46, which is known per se and will not be described in great detail, is maintained in a sealed condition by a cap 48 or shrink wrap or other sealing means to minimise the possibility of actuating the valve before the relative rotation of the compartment 16 and closure body 21 to release the contents 30 of the compartment into the container 20. However, once the contents 30 have been mixed, and the cap, shrink wrap or other sealing means is removed, the release valve 46 is able to be used to remove beverage or other contents from the container 20. The release valve 46 has channels 46*a* by which, when the outer portion of the release valve is moved inwardly, relative to the top wall 18 to cut open the valve wall 46*b*, the compartment is open to the atmosphere to permit extraction of the container 20 contents.

Referring to FIGS. 22 and 23, the embodiment illustrated is similar in some respects to that of FIGS. 18 and 19. In this embodiment, however, the compartment 16 is formed by the intermediate wall 23, which is integral with the outer wall side wall 22, the top wall 18 and the bottom wall or membrane 19. This forms a sealed compartment 16 in which is located the wall cutting structure comprising the side wall 17 having its lower edge formed as a cutting knife, and an inner top wall 18*a* by which the side wall 17 may be axially moved.

As shown in FIG. 23, the top wall 18 of the closure 15 is flexible or deformable, such as by forming the periphery thereof as a hinge, so that the centre thereof is able to be axially moved downwardly thereby causing the cutting knife to cut through the bottom wall 19.

Preferably, the centre section of the inner top wall 18*a* is connected, such as by a cooperating rib and groove forming a snap fit, or by adhesive or other means, to the outer top wall 18.

As with the embodiment shown in FIGS. 18 and 19, a portion 50 of the side wall 17 is relieved adjacent a hinge 50*a* whereby a section of the bottom wall 19 is not cut by the cutter, thereby allowing the cut wall part to fold down about the hinge 50*a* to allow the contents 30 to fall into the container 20. The cutting edge can also be similar to the serrated cutter of FIGS. 18 and 19.

Figure 25:
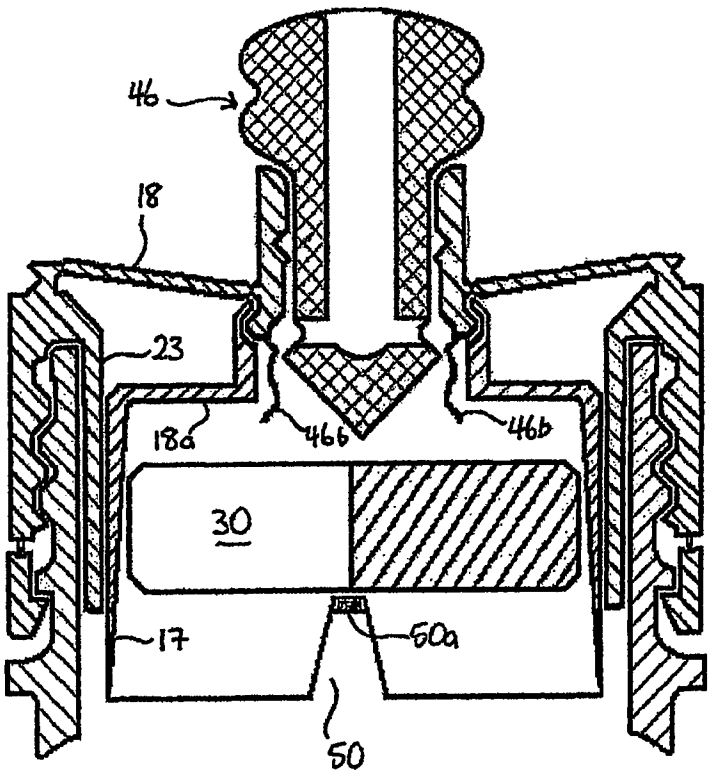
FIG. 25 is a cross sectional, elevational view of the twelfth embodiment of the invention taken at 900 to that of FIG. 24, and showing an initial actuation of the closure
Figure 24:
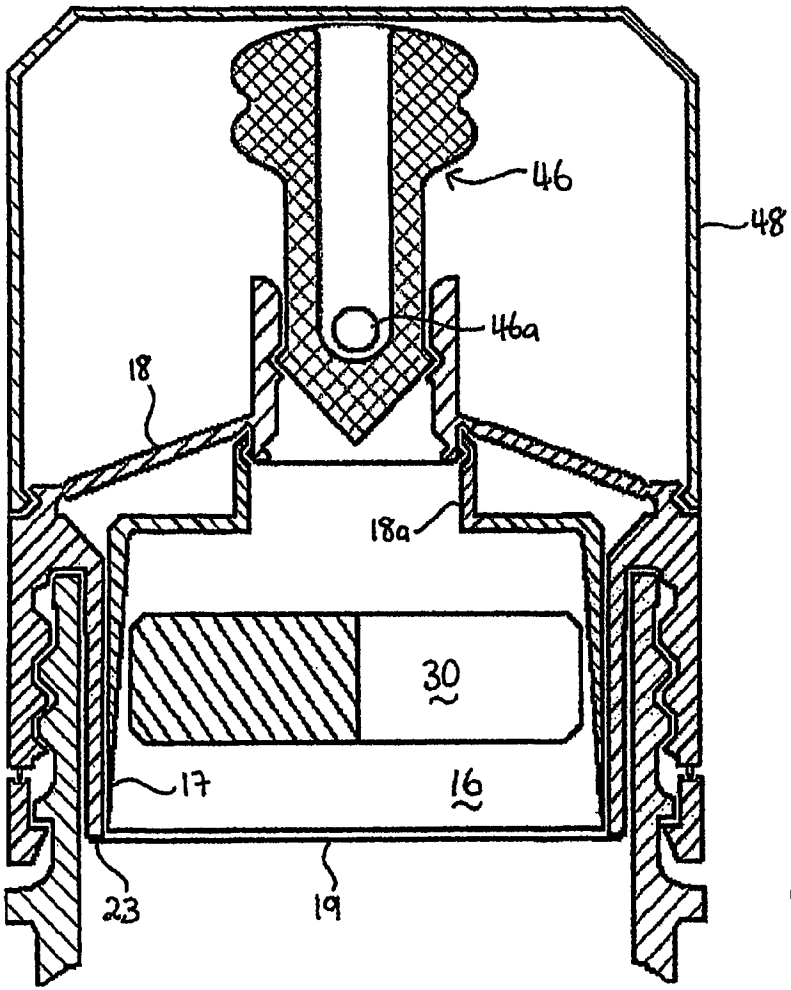
FIG. 24 is a cross sectional, elevational view of a twelfth embodiment of the invention.

FIGS. 24 and 25 illustrate a modified form of the embodiment of FIGS. 22 and 23 in which the inner top wall 18*a* is omitted and the top wall 18 is formed with a release valve 46 that operates in a similar fashion to that described with reference to FIGS. 20 and 21. In this embodiment, a cap 48 prevents inadvertent operation of the valve and the cutting structure. On removal of the cap 48, movement of the valve 46 towards the container 20 firstly causes the top wall 18, that is integral with the valve housing, to move downwardly relative to the side wall 23 thereby causing the inner top wall 18*a* and associated side wall 17 to move relative to the bottom wall 19. The cutting knife edge on the lower edge of the side wall 17 cuts through the bottom wall 19 thus allowing the contents 30 of the compartment 16 to drop into the container 20 for mixing with the contents thereof.

Further downward movement of the valve 46 stem cuts or breaks the frangible membrane 19*a* closing the bottom of the valve housing so that the mixed container contents are able to be dispensed through the channels 46*a* and the outlet of the valve 46. The cutting edge could also be similar to the serrated cutter.

FIG. 26 illustrates a closure 15 that may be a closure of any one of the embodiments of FIGS. 1 and 2, 5 and 6, or 9 and 10.

The rim 26 extending radially outwardly and downwardly of the top wall 18 has an opening 33 (FIG. 27) to receive the tamper evident tab 32*a* which is integral with the upper edge of the outer wall 22 to thereby prevent inadvertent relative rotation between the rim 26 and the closure body 21.

It will be appreciated that it is important, when assembling the compartment 16 with the closure body 21 that the parts are properly aligned so that the cutting blade 31 is appropriately located in a position which does not cause it to cut into the bottom wall 19 prior to intended use. The tamper evident tab 32*a* thereby also serves that purpose of ensuring proper alignment as a registration point when the parts are assembled.

The lower edge of the outer side wall 22 is integrally formed with a tamper evident band 32 that snaps behind a shoulder 32*b* formed on the container neck when the closure 15 is engaged on the neck of a beverage container 20 or the like, to prevent removal of the closure from the container 20 without removing the tamper evident band 32.

FIG. 27 illustrates one form of compartment 16 such as is used in the closure of FIG. 26. The compartments 16 described and illustrated with reference to FIGS. 1 to 25, may contain a single product 30 to be dispensed into a container 20 which, in one example, may hold a beverage or the like. However, the compartment 16 may be divided into two or more parts by a dividing walls 47 thereby enabling two or more products to be dispensed from the dispensing closure 15. Thus, the contents 30 of a twin compartment 16, as shown in FIG. 28, may be dispensed as alternate products or sequentially to dispense both products.

Referring to FIG. 29, a compartment may be divided into three or more chambers by walls or partitions 47. This allows three substances to be dispensed by causing relative rotation of the compartment 16 and the closure body 21 so that the cutting knife cuts through the frangible bottom wall 19 until it reaches a petition or dividing wall 47 at which it then jumps across the petition wall into the next compartment as rotation is continued. The top wall 18 of the compartments 16 may be appropriately marked to indicate the contents 30 thereof so that selections may be made in dispensing those contents 30. Thus, one compartment may contain a beverage mix, such as coffee, while another compartment contains sugar granules and a third compartment contains a creamer. The user is thus able to choose a desired mix.

Referring to FIG. 30, there is illustrated one embodiment of a cutting blade 31 for use in the performance of the invention. The cutting blade 31 is preferably formed by moulding of the same material as is used in the construction of the compartment 16 and/or the closure body 21. The blade 31 is moulded integrally with the respective wall parts of the closure 15. The blade 31 is specifically designed to first cut through the frangible bottom wall 19, which may be a membrane formed of synthetic plastics material, aluminium foil or any other suitable material used as the frangible bottom wall 19. The blade includes, on each side, a first cutting edge 51 and a second cutting edge 52. In use, with the wall 19 moving in the direction of arrow "A" relative to the blade 31, the first cutting edge 51 cuts into the wall 19. As the relative position of the wall changes, due to the angle between the wall 19 and the plane perpendicular to the rotational axis, the wall 19 moves axially relative to the cutting edge 51 until it reaches the second cutting edge 52. Continued relative movement results in the membrane material being peeled back from the opening formed by the cutting blade 31 so that the bottom wall 19 is peeled away from its engagement with the respective compartment wall thereby permitting compartment contents 30 to fall into the container 20 without hindrance by the bottom wall 19. Embodiments of the invention will be designed so that the bottom wall 19 is not completely removed from its attachment to the respective compartment wall so as not to full into the container 20. Thus, a stop or other means may be provided to reduce the likelihood of the bottom wall 19 being completely removed and falling into the container 20.

By having a cutting blade 31 formed with opposing edges as illustrated in FIG. 30, the direction of relative rotation is irrelevant as either side of the blade is able to be used according to the direction of relative rotation.

FIG. 31 illustrates another embodiment of cutting blade 31 having two legs each with three cutting edges 51, 52 and 53. This blade works in a similar manner to that of FIG. 30 except that, if the direction of relative rotation is reversed, the blade edges 53 can also cut the material of the bottom wall 19.

The invention claimed is:

1. A dispensing closure for dispensing at least one product into a container having a neck portion with which said closure is to engage, said dispensing closure comprising:

a body having an outer wall portion adapted to engage an outer surface of the container neck to releasably secure said closure to the container;

a compartment to contain at least one product to be dispensed, said compartment being adapted to fit at least partly within the container neck and being defined by a substantially cylindrical side wall, a top wall fixed to said side wall, and a frangible bottom wall;

a cutting means moveable relative to said side wall and said frangible bottom wall to break open said frangible bottom wall of said compartment to selectively dispense contents of said compartment into the container; and a shoulder for restricting inadvertent relative movement of said cutting means, said closure and product to be dispensed being assembled together prior to application of the closure to the container neck.

2. The dispensing closure according to claim 1, wherein said outer wall portion of said body is substantially cylindrical, and said body further includes a coaxial inner wall adapted to engage within the container neck.

3. The dispensing closure according to claim 2, wherein said outer wall portion of said body is provided with internal threads adapted to threadingly engage a threaded neck of a container to which said closure is to be fitted.

4. The dispensing closure according to claim 2, wherein said inner wall closely engages within the container neck, and said compartment fits within said inner wall.

5. The dispensing closure according to claim 4, wherein said compartment is separate from said body and is interconnected thereto to facilitate relative rotation therebetween about the axes thereof.

6. The dispensing closure according to claim 5, wherein an upper end of said compartment is formed with a rim having engaging means to engage a corresponding engaging means on said closure body whereby said compartment is assembled to said body and is rotatable relatively thereto.

7. The dispensing closure according to claim 6, wherein said compartment and said body are able to be snap-fitted together so that said compartment is able to rotate about its axis relative to said body.

8. The dispensing closure according to claim 7, wherein said bottom wall of said compartment extends at an angle to a plane perpendicular to the axis.

9. The dispensing closure according to claim 8, wherein said cutting means includes a cutting knife carried on a flange extending generally radially inwardly from a lower edge portion of an inner wall of said body, said flange being axially spaced from said frangible bottom wall of said compartment, said knife extending in a generally axial direction from said flange towards said frangible bottom wall.

10. The dispensing closure according to claim 8, wherein said cutting means includes a cutting knife extending axially from said top wall of said compartment inwardly of said compartment side wall and movable about the axis, and wherein on relative movement of said knife, said frangible bottom wall is brought into contact with said knife which cuts and breaks open said bottom wall from said compartment permitting contents thereof to be dispensed into the container to which said closure is fitted.

11. The dispensing closure according to claim 3, wherein said compartment and body are integral such that said cylindrical side wall of said compartment constitutes an inner wall of said body, and a substantially cylindrical band engages with an outer surface of said side wall adjacent its free edge, said band having a generally radially inwardly extending flange carrying said cutting means.

12. The dispensing closure according to claim 11, wherein said cutting means is a cutting knife which extends from said flange in a generally axial direction towards said top wall.

13. The dispensing closure according to claim 12, wherein said cutting knife is housed in a pocket formed in said side wall of said compartment, said cutting knife being movable about the axis of said compartment to be released from said pocket so as to then cut said bottom wall at least partly from the container to allow the product in said compartment to pass into the container.

14. The dispensing closure according to claim 7, wherein said cutting means includes a cutting knife carried on a flange extending generally radially inwardly from a lower edge portion of an inner wall of said body, said flange being axially spaced from said frangible bottom wall of said compartment, said knife extending in a generally axial direction from said flange towards said top wall, said cutting knife being housed in a pocket formed in said side wall of said compartment, said cutting knife being movable about the axis of said compartment to be released from said pocket so as to then cut said bottom wall at least partly from said container to allow the product in said compartment to pass into the container.

15. The dispensing closure according to claim 8, wherein said compartment is axially moveable relative to said cutting means to cause said cutting means to cut said frangible bottom wall.

16. The dispensing closure according to claim 15, wherein said cutting means comprises a cutting knife integrally moulded with a wall of said closure, said knife having at least two cutting edges extending at an acute angle to each other.

17. The dispensing closure according to claim 8, wherein said cutting means comprises a knife edge formed on a lower edge portion of an internal wall extending from said compartment top wall, said top wall being axially movable relative to said bottom wall to cause said knife edge to cut away at least a portion of said bottom wall to allow the product in said compartment to pass into the container.

18. The dispensing closure according to claim 17, wherein a centre portion of said top wall is resiliently axially movable relative to said closure body, and said internal wall is connected to said centre portion to be movable therewith whereby said frangible bottom wall is cut by a resilient axial movement of said centre portion.

19. The dispensing closure according to claim 1, wherein said body includes, on a lower edge of said outer wall, a tamper proof evidence release band to provide an indication of tampering with said closure prior to its use.

20. The dispensing closure according to claim 1, wherein said body includes, on an upper edge of said outer wall portion, a tab adapted to engage within an opening formed in a rim of said compartment, said tab ensuring proper alignment of said compartment and said body when assembled as well as acting to resist inadvertent relative movement of said cutting means.

21. The dispensing closure according to claim 1 further comprising a contents dispensing valve integrally formed with said top wall of said compartment to facilitate dispensing contents of the container after said frangible bottom wall of said compartment has been cut to allow the product in said compartment to pass into the container.

22. The dispensing closure according to claim 1, wherein said compartment is separated into a plurality of parts by one or more internal partitions to separately house a plurality of different products to be selectively dispensed into the container.

23. A dispensing closure for a container having a neck portion, said dispensing closure comprising:

a body having engaging means and an outer wall portion adapted to engage an outer surface of the container neck to releasably secure said closure to the container, said outer wall portion includes an upper edge having a tamper proof evidence release band to provide an indication of tampering with said closure prior to its use, wherein said outer wall portion of said body is substantially cylindrical, and said body further includes a coaxial inner wall adapted to engage within the container neck;

a compartment to contain at least one product to be dispensed, said compartment being adapted to fit at least partly within the container neck and being defined by a substantially cylindrical side wall, a top wall fixed to said side wall, and a frangible bottom wall, wherein an upper end of said compartment is formed with a rim having engaging means to engage said engaging means on said closure body whereby said compartment is assembled to said body and is rotatable relatively thereto, said bottom wall of said compartment extends at an angle to a plane perpendicular to the axis;

a cutting knife attached to said body and moveable relative to said side wall and said frangible bottom wall to break open said frangible bottom wall of said compartment to selectively dispense contents of said compartment into the container;

shoulder located on said compartment for restricting inadvertent relative movement of said cutting knife;

a contents dispensing valve integrally formed with said top wall of said compartment to facilitate dispensing contents of the container after said frangible bottom wall of said compartment has been cut to allow the product in said compartment to pass into the container; and wherein said upper edge of said outer wall portion further includes a tab adapted to engage within an opening formed in a rim of said compartment, said tab ensuring proper alignment of said compartment and said body when assembled as well as acting to resist inadvertent relative movement of said cutting means.

24. The dispensing closure according to claim 23, wherein said cutting means includes a cutting knife carried on a flange extending generally radially inwardly from a lower edge portion of an inner wall of said body, said flange being axially spaced from said frangible bottom wall of said compartment, said knife extending in a generally axial direction from said flange towards said frangible bottom wall.

25. The dispensing closure according to claim 23, wherein said cutting means includes a cutting knife extending axially from said top wall of said compartment inwardly of said compartment side wall and movable about the axis, and wherein on relative movement of said knife, said frangible bottom wall is brought into contact with said knife which cuts and breaks open said bottom wall from said compartment permitting contents thereof to be dispensed into the container to which said closure is fitted.

26. A method of dispensing at least one product into a container having a neck, the method including the steps of:

providing a dispensing closure comprising a body having an outer wall portion adapted to engage an outer surface of the container neck to releasably secure said closure to the container; a compartment to contain at least one product to be dispensed, said compartment being adapted to fit at least partly within the container neck and being defined by a substantially cylindrical side wall, a top wall fixed to said side wall, and a frangible bottom wall, wherein an upper end of said compartment is formed with a rim having engaging means to engage a corresponding engaging means on said closure body whereby said compartment is assembled to said body and is rotatable relatively thereto, said bottom wall of said compartment extends at an angle to a plane perpendicular to the axis; a cutting knife attached to said body and moveable relative to said side wall and said frangible bottom wall to break open said frangible bottom wall of said compartment to selectively dispense contents of said compartment into the container; and a shoulder for restricting inadvertent relative movement of said cutting knife;

placing a product to be dispensed into said compartment between said top wall and said frangible bottom wall;

sealing said frangible bottom wall to said side wall of said compartment;

assembling said compartment containing the product with said closure body;

engaging said assembled closure with a neck portion of a container into which the product is to be dispensed; and axially moving said knife relative to the bottom wall to cause said knife to cut into said bottom wall to thereby release the contents of said compartment into the container.

* * * * *